United States Patent [19]

Bibbens

[11] 4,067,218

[45] Jan. 10, 1978

[54] APPARATUS AND METHOD AND MEANS FOR REMOVING SURFACE DEFECTS FROM A WORKPIECE

[76] Inventor: William H. Bibbens, 16500 N. Park Drive, Southfield, Mich. 48075

[21] Appl. No.: 751,409

[22] Filed: Dec. 16, 1976

[51] Int. Cl.[2] ..... B21H 5/00

[52] U.S. Cl. ..... 72/107; 72/245; 72/453.01

[58] Field of Search ..... 72/107, 108, 245, 453.01; 29/90 B, 159.2

[56] References Cited

U.S. PATENT DOCUMENTS

| | | | |
|---|---|---|---|
| 274,856 | 3/1883 | Uren | 72/245 |
| 1,365,386 | 1/1921 | Djidics | 72/104 |
| 2,352,557 | 6/1944 | Miller | 29/90 B |
| 3,017,697 | 1/1962 | Wlodek | 72/104 |

*Primary Examiner*—Lowell A. Larson

*Attorney, Agent, or Firm*—Reising, Ethington, Barnard, Perry & Brooks

[57] ABSTRACT

Apparatus and a method for use thereof to remove surface defects from a formed workpiece having a rotary axis about which the workpiece is designed to rotate. A plurality of rotary tools, preferably three, of the apparatus are rotatably mounted in spaced relationship to each other to receive the workpiece therebetween in engagement therewith during rotation of the tools and the workpiece. Pressure applied to each of the tools independently of each other tool maintains an engaged condition between the tool and the workpiece while allowing outward tool movement upon engagement with a surface defect such that the rotary workpiece axis remains at a fixed location. Extendable and retractable hydraulic cylinders are preferably utilized to apply the pressure between the tools and the workpiece and the engagement therebetween is at intermeshed teeth thereof so as to remove surface defects from the workpiece teeth. Each cylinder includes a bore and an undersized piston received within the bore. Hydraulic fluid supplied to the cylinders applies pressure between the tools and the workpiece while the fluid leaks past the pistons at a predetermined rate and, upon engagement of a tool with a surface defect on the workpiece, an increased rate of leakage flow permits cylinder retraction that allows outward tool movement without movement of the workpiece. A power drive mechanism of the apparatus rotates one of the tools with a synchronizer rotating the other tools prior to meshing engagement of the workpiece with the tools. After a movable carriage of a carrier moves the workpiece into meshing engagement with the tools, the workpiece synchronizes the rotation of the tools with each other. The drive mechanism increases the rate of rotation after the tools are meshed with the workpiece and rotates the tools in opposite directions to apply pressure that removes surface defects from both sides of the workpiece teeth.

21 Claims, 13 Drawing Figures

APPARATUS AND METHOD AND MEANS FOR REMOVING SURFACE DEFECTS FROM A WORKPIECE

BACKGROUND OF THE INVENTION

1. Field of the Invention

This invention relates to apparatus and a method for using the apparatus to remove surface defects from a formed workpiece and, more particularly, to remove surface defects from the teeth of a rotary gear.

2. Description of the Prior Art

Apparatus has heretofore been provided to remove surface defects from a formed rotary workpiece such as a rotary gear having teeth generated around a central rotary axis of the gear about which it rotates. The surface defects may be scratches or nicks, etc., and can cause rejection of the gear during quality control checking. Rejected gears necessarily cause an increase in the price of gears that are accepted during the quality control checking.

Apparatus for removing gear surface defects has been embodied by machines that are referred to as burnishing machines. During use, prior art machines of this type rotate the workpiece being processed while engaging a plurality of rotary tools with the workpiece. Pressure that maintains the engaged condition of the tools and the workpiece is supplied by a single movable tool. The other tools rotate about respective fixed axes while the movable tool moves toward and away from the other tools as the tools engage "high spot" defects on the workpiece. When one of the fixed tools engages a "high spot" defect on the tool, the workpiece moves along with the movable tool away from the fixed tools. Such movement of the workpiece as it is being processed causes an instanteous rapid sliding movement between the interengaged surfaces of the tools and the workpiece.

SUMMARY OF THE INVENTION

An object of the present invention is to provide a method and means for removing surface defects from a formed workpiece by engaging rotary tools with the workpiece while it is rotated with a rotary axis thereof maintained at a fixed location.

Another object of the invention is to provide apparatus and a method for using the apparatus to remove surface defects from the teeth of a toothed workpiece, i.e. a rotary gear, by applying pressure independently to a plurality of rotary tools having teeth meshed with the workpiece such that the pressure applied allows each tool to move outwardly away from the workpiece independently of each other tool upon engagement with a surface defect so as to allow the workpiece to continue rotating about a fixed rotational axis.

A further object of the invention is to provide a method and means for removing surface defects from a rotary tooth workpiece by rolling the workpiece under pressure between rotary tools wherein each rotary tool is supported by an associated retractable and extendable hydraulic cylinder having a bore and piston received therein having sufficient clearance with the bore such that hydraulic fluid continuously supplied to the cylinder bore can leak past the piston when the associated tool engages a surface defect to permit cylinder retraction and consequent outward tool movement independently of each other tool.

It has been found that gears processed by apparatus and the method of the above objects have a greatly reduced rejection rate during quality control checking. The rejection rate is lower than when the gears are processed by prior art machines of the type involved. Consequently, a reduced cost for the processed gears that are accepted after quality control checking is achieved.

In carrying out the preceding objects and other objects, a preferred embodiment of the invention includes three toothed rotary tools whose associated hydraulic cylinders are oriented to move the tools along radial directions with respect to the workpiece rotary axis with the radial directions spaced at 120° from each other. Hydraulic fluid is supplied to the cylinders by a common pump to apply the same pressure between each tool and the workpiece, and this spacing and orientation of the cylinders is such that a balanced condition of the workpiece is present with each cylinder applying the same pressure to the workpiece. Each cylinder includes a bore and an undersized piston received therein such that the leakage flow past the piston occurs at a predetermined rate. When the tool associated with one cylinder engages a "high spot" defect on the workpiece, the leakage flow rate increases so the cylinder can retract and move the tool outwardly away from the workpiece. The other tools do not move then unless they too are simultaneously engaging a "high spot" defect, and the net effect is that the workpiece continues to rotate with its axis at a fixed location.

A carrier of the preferred embodiment includes a movable carriage utilized to position a toothed workpiece, such as a rotary gear, into meshing engagement with the three toothed rotary tools. Prior to meshing of the gear with the tools, a synchronizer drives two of the rotary tools from one power driven tool that is driven by an electric motor drive mechanism. The synchronizer includes sprockets on the rotary tools and a chain that is trained over the sprockets. An idler sprocket tensions the chain before the carriage has moved the gear into meshing relationship with the tools and loosens the chain after this meshing takes place so the gear synchronizes the rotation of the tools. A speed control moves the carriage at a fast rate prior to meshing of the gear with the tools and at a slow rate as this meshing takes place. This speed control is preferably accomplished by use of a hydraulic valve that is actuated by the carriage movement. One of the nondriven rotary tools is axially offset from the other two tools so as to initially engage the gear. The axially offset tool is axially supported in a resilient manner so as to yield if its teeth and the teeth of the gear do not mesh as they initially engage each other. If the axail movement of the offset tool is too great, a limit switch is actuated to terminate the rotation and the carriage movement. During normal operation as the gear is moved between the tools in meshing relationship therewith, the cylinders are retracted such that the tools are spaced from the gear with clearances that permit the meshing to readily take place. Subsequent to termination of carriage movement axially positioning the gear between the tools, the cylinders are supplied hydraulic fluid so as to move to an extended condition and to thereby independently apply pressure between each tool and the gear.

Once the pressure is applied to the gear by the tools meshed therewith, the drive mechanism increases the rate of rotation so that the meshing of the tool teeth with the gear teeth will remove surface defects. The direction of rotation is reversed after a predetermined period of time to complete the defect removal cycle and the cylinders are then retracted to release the pressure between the tools and the gear such that the carriage can remove the processed gear and subsequently position another gear between the tools ready for another cycle.

The pressure which must be applied between the gear and the tools is governed by two factors, the hardness of the gear tooth surfaces and the strength of the gear teeth before breakage will occur. Pressure applied must be great enough so that the tool teeth will remove defects from the tooth surfaces of the gear during the meshing with the tools. On the other hand, the pressure must not be so great as to cause breakage of the gear teeth as the meshing takes place.

When the gear to be processed has certain tooth forms, each of the rotary tools has a tooth form identical to the tooth form of the other tools. However, other tooth forms of the gear require each tool to have a different tooth form along the axial length thereof than the other tools. Different axial portions of the gear teeth thus have defects removed from the axial surface portions thereof by each rotary tool when the latter type of gear tooth form is present.

The foregoing objects and other objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
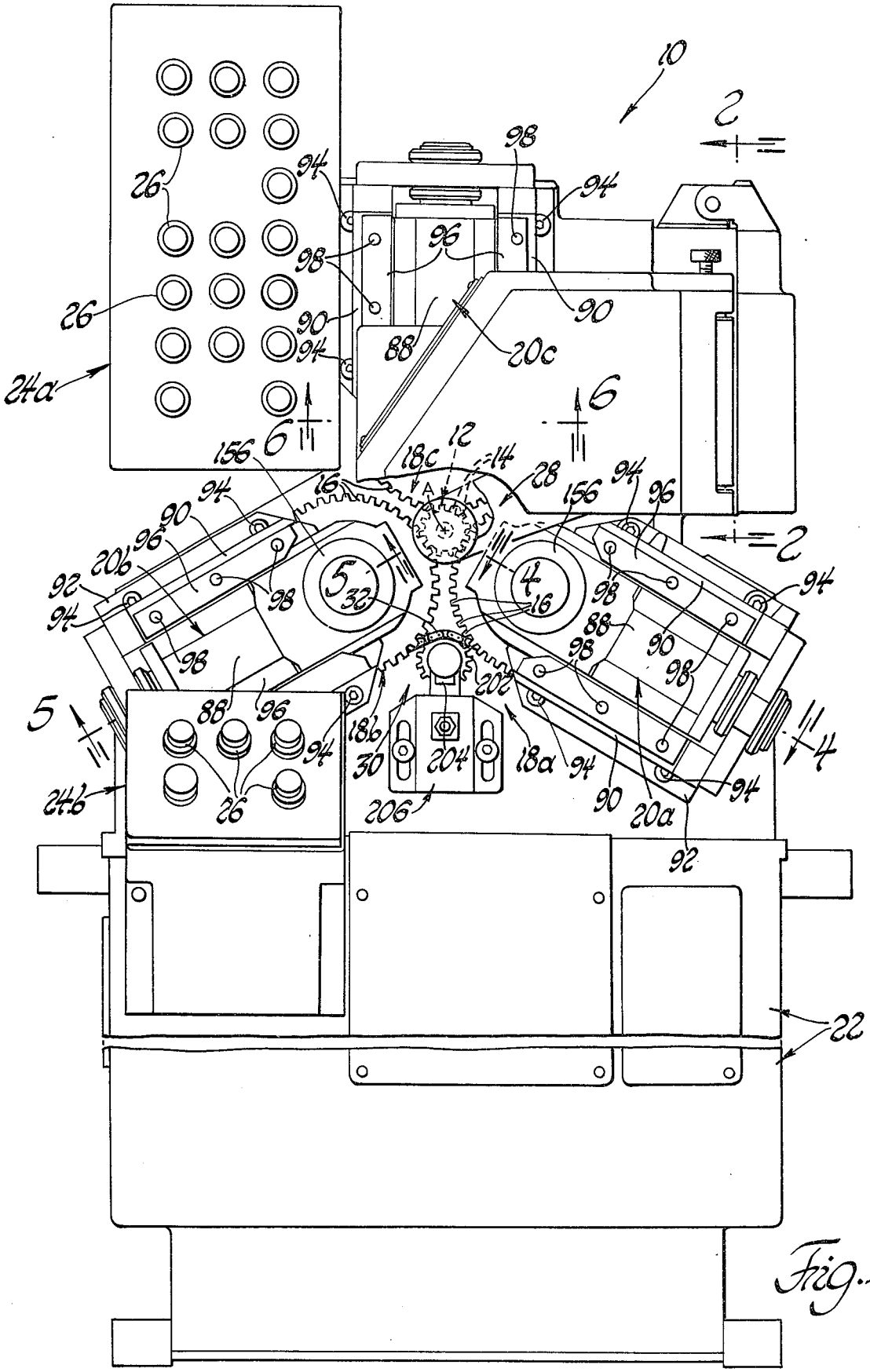
FIG. 1 is a partially broken away front elevation view of a machine embodying apparatus according to the present invention.

Referring to FIG. 1 of the drawings, a machine which embodies apparatus of the present invention and is used in accordance with the method thereof is collectively indicated by reference numeral 10. A formed part or workpiece to be processed, by machine 10 is illustrated as a rotary gear 12 having teeth 14 that mesh with teeth 16 of three rotary tools 18*a*, 18*b*, and 18*c*. The rotary tools are respectively supported by hydraulic cylinders 20*a*, 20*b*, and 20*c* that are oriented in 120° spaced relationship with respect to each other about a central rotary axis A of gear 12. A floor mounted housing of the machine is collectively indicated by reference numeral 22 and supports the hydraulic cylinders 20*a*, 20*b*, and 20*c* as well as control panel portions 24*a* and 24*b*. The control panel portions include suitable buttons, knobs, indicator lights, etc. 26 utilized to control and indicate the operational condition of the machine. A carrier 28 of the machine is utilized to position the gear 12 in meshing relationship with the rotary tools 18*a*, 18*b*, and 18*c*. The gear 12 then synchronizes the rotation of each rotary tool with the others. Prior to the meshing of the gear with the tools, a synchronizer 30 including a chain 32 synchronizes the tool rotation.

Figure 3:
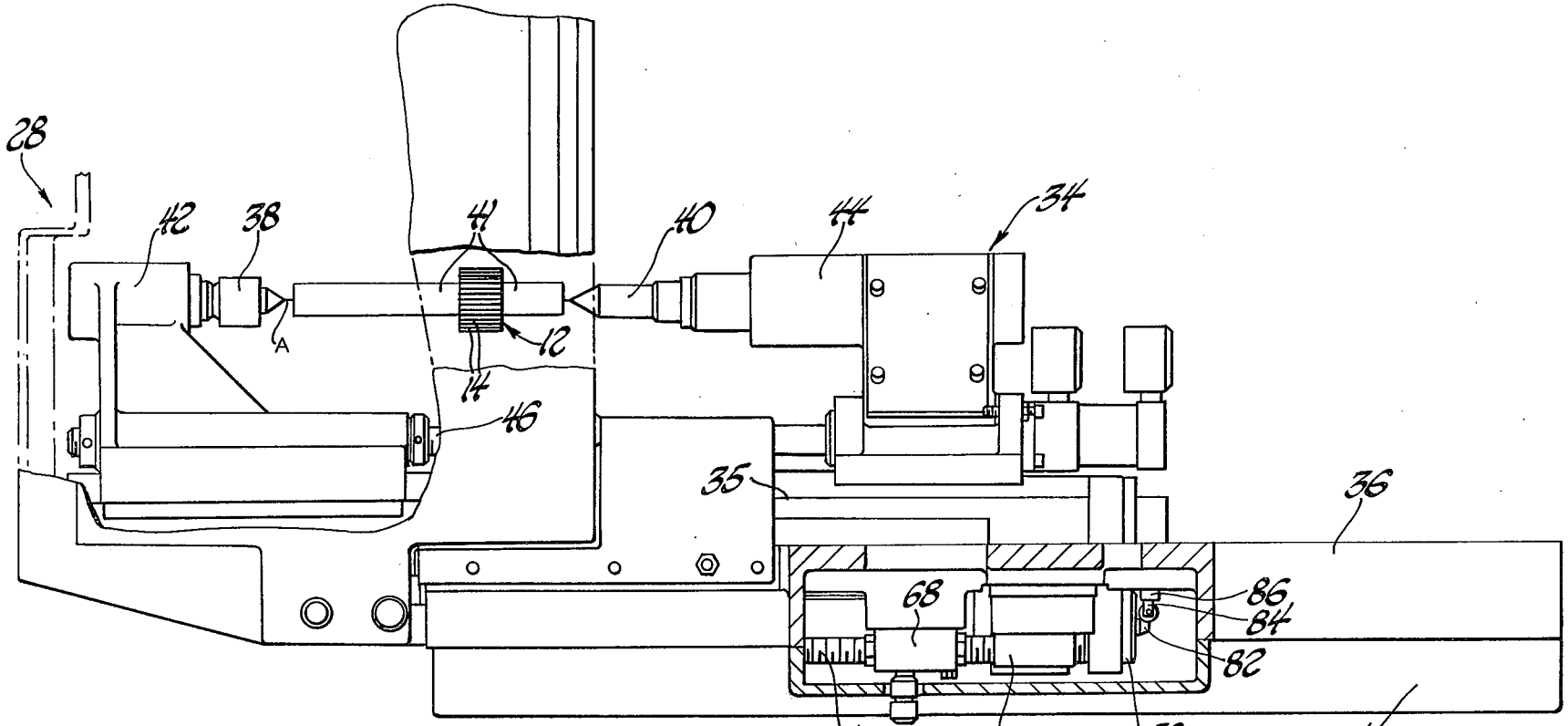
FIG. 3 is a sectional view taken in plan direction along line 3—3 of FIG. 2 but with the cover pivoted downwardly to a closed position.

With reference to FIG. 3, the carrier 28 includes a movable carriage 34 that is mounted for forward and rearward movement with respect to the machine 10 on a horizontal slideway 35 of a machine housing portion 36. Front and rear spindles 38 and 40 of the carriage are utilized to support opposite ends of a shaft 41 on which the gear 12 is formed. The front spindle 38 is supported by a spindle housing 42 while the rear spindle 40 is supported by a spindle housing 44. A screw 46, shown partially in FIG. 3, is utilized to move the spindle housings 42 and 44 toward and away from each other so as to engage and release the shaft 41. A conveyor, not shown, carries the parts to be processed by the machine along its front extremity with the carriage 34 in the forward position shown by FIG. 3. Screw 46 is rotated by a suitable drive to move the spindles 38 and 40 toward each other to engage and mount the opposite ends of the shaft as it is aligned with the spindles. Subsequently, rearward movement of the carriage 34 along the slideway 35 to the right as shown in FIG. 3 moves the gear 12 on the shaft toward the rotary tools 18*a*, 18*b*, and 18*c*.

Figure 2:
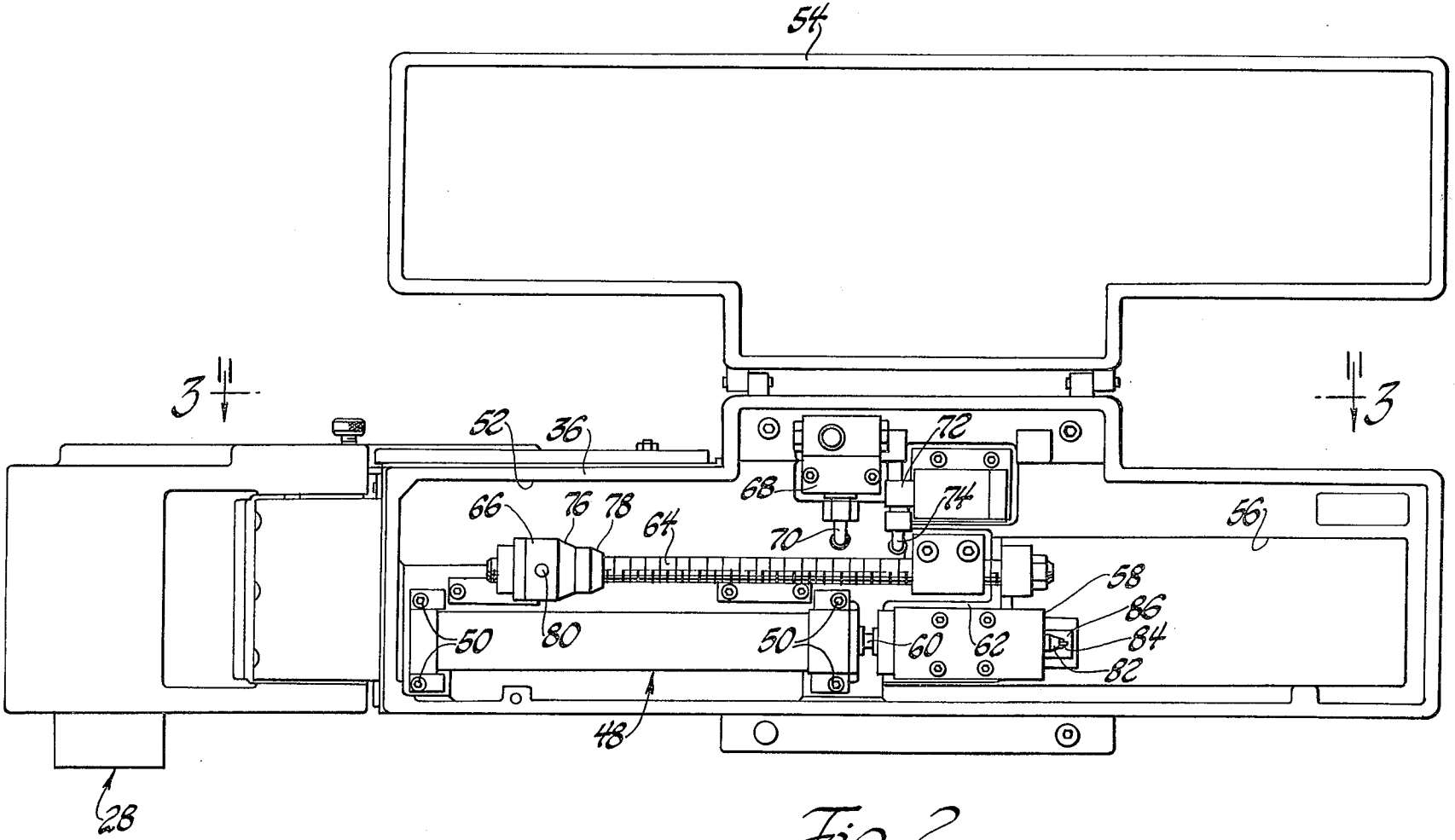
FIG. 2 is a side elevation view taken along line 2—2 of FIG. 1 with a cover of the machine pivoted upwardly to an open position.

Movement of the carriage 34 shown in FIG. 3 is actuated by a hydraulic cylinder 48 shown in FIG. 2. Bolts 50 mount the opposite ends of cylinder 48 within a chamber 52 of the housing portion 36. A pivotal cover 54 of the housing portion 36 is movable between the open position of FIG. 2 and the closed position of FIG. 3 to selectively open or close the chamber defined within the housing portion. An opening 56 in housing portion 36, FIG. 2, receives a carriage portion 58 that projects into the housing 36 for connection to the outer end of a piston connecting rod 60 of hydraulic cylinder 48. Retraction and extension of the cylinder by hydraulic fluid acting on the opposite ends of a piston connected to the inner end of rod 60 moves the carriage to the left and to the right in forward and rearward directions, respectively, with respect to the machine. An L-shaped bracket 62 mounted on carriage portion 58 fixedly supports one end of a threaded control rod 64 whose other end supports a control member 66. Intermediate its ends, control rod 64 is slidably supported by a support 67 on the housing portion 36. A fluid flow control valve 68 having a valve actuator 70 and a limit switch 72 having a switch arm 74 are actuated by control surfaces 76 and 78 of the control member 66. The control valve 68 is actuated during rearward carriage movement just prior to engagement of the gear 12 carried by the carriage with the rotary tools 18*a*, 18*b*, and 18*c*. The valve actuation then limits the flow of hydraulic fluid to cylinder 48 so as to slow the carriage movement as the gear moves into a meshing relationship with the rotary tools. Subsequently, the limit switch 72 is actuated to terminate the rearward carriage movement. A set screw 80 is tightened to fix the axial position of the control member 66 along the length of the control rod 64 and is loosened to permit adjustment of the control member so as to adjust the rearward position to which the carriage moves prior to actuation of the valve and the limit switch.

As seen by combined reference to FIGS. 2 and 3, the hydraulic cylinder piston connecting rod 60 extends through the carriage portion 58 so that its extreme end 82 is located adjacent a switch arm 84 of a limit switch 86 mounted on the carriage. Within the carriage portion 58, a biasing spring engages a suitable flange on the piston connecting rod to maintain the rod against relative movement toward the right with respect to the carriage. However, upon overloading of the cylinder, this biasing spring permits the connecting rod to move to the right relative to the carriage such that the rod end 82 actuates the switch arm 84 and switch 86 then terminates the supply of hydraulic fluid to the cylinder. An overload condition of the cylinder is thus prevented.

As seen by combined reference to FIGS. 1 and 4–6, each cylinder **20*a*, 20*b*, and 20*c* includes a cylinder housing 88 slidably mounted between spaced side walls 90 (FIGS. 1 and 6) for movement toward and away from the gear 12 along radial directions with respect to the central gear axis A. The directions of cylinder movement are spaced from each other at 120° so that pressure applied by the cylinders through the rotary tools to the gear is balanced when each cylinder exerts the same force. The side walls 90 (FIG. 6) have inner ends integrally connected to a base 92 that is secured to the machine housing 22 by bolts 94 shown in FIG. 1. Outer ends of the side walls support elongated flange plates 96 that are secured thereto by bolts 98 so as to slidably engage the cylinder housing 98** in a captured manner that maintains the cylinders in their slidably supported condition.

Figure 4:
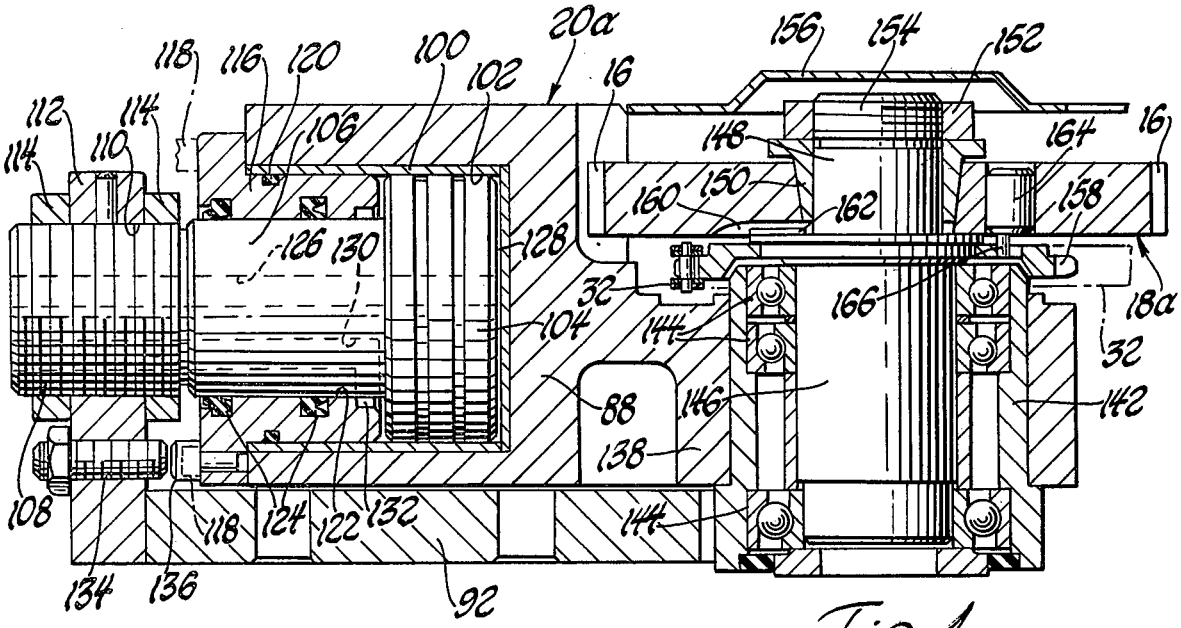
FIGS. 4, 5, and 6 are sectional views of the machine respectively taken along lines 4—4, 5—5, and 6—6 of FIG. 1.

With reference to FIG. 4, the construction of the hydraulic cylinder **20*a* will now be described with the understanding that this construction is also applicable to the other cylinders 20*b* and 20*c* except for variations that will be mentioned. A thin wall annular sleeve 100 of the cylinder housing 88 defines a round bore 102 which slidably receives an undersized piston 104. Piston 104 includes an integral connecting rod 106 with a threaded end 108 received by an aperture 110 in a plate 112 that is suitably secured to the side wall base 92. Securement nuts 114 positioned on opposite sides of the plate 112 are threaded onto the end 108 of the piston connecting rod so as to fixedly locate the piston 104 in the position shown. An annular end closure member 116 is also received within the cylinder bore 102 and is fixedly located with respect to the cylinder housing 88 by suitable screws 118 shown in phantom line. An O-ring seal 120 prevents escape of hydraulic fluid from the cylinder between the closure member 116 and the sleeve 100. A central opening 122 of the closure member 116 slidably receives the piston connecting rod 106 with annular seals 124 preventing escape of hydraulic fluid at the sliding interfaces of these components. A passage 126 through the piston 104 and its connecting rod 106 supplies hydraulic fluid to the cylinder 88 at a bore chamber 128 so as to slide the cylinder housing 88 toward the right for a small extent of movement, i.e. on the order of one-hundred thousandths of an inch. Likewise, a passage 130 through the piston connecting rod feeds hydraulic fluid to an annular chamber 132 on the other side of the piston so as to slide the cylinder housing 88 toward the left for the same extent of movement. The sliding movement of the cylinder housing to the right moves the cylinder into an extended condition while the movement to the left moves it into a retracted condition. Extension of the cylinders applies pressure between the tools carried thereby and the gear being processed, as is more fully described later. The degree of cylinder housing movement toward the left is controlled by an adjustable screw stop 134 which is mounted on the plate 112 and engaged with a pin 136 on the end closure member 116**.

Figure 5:
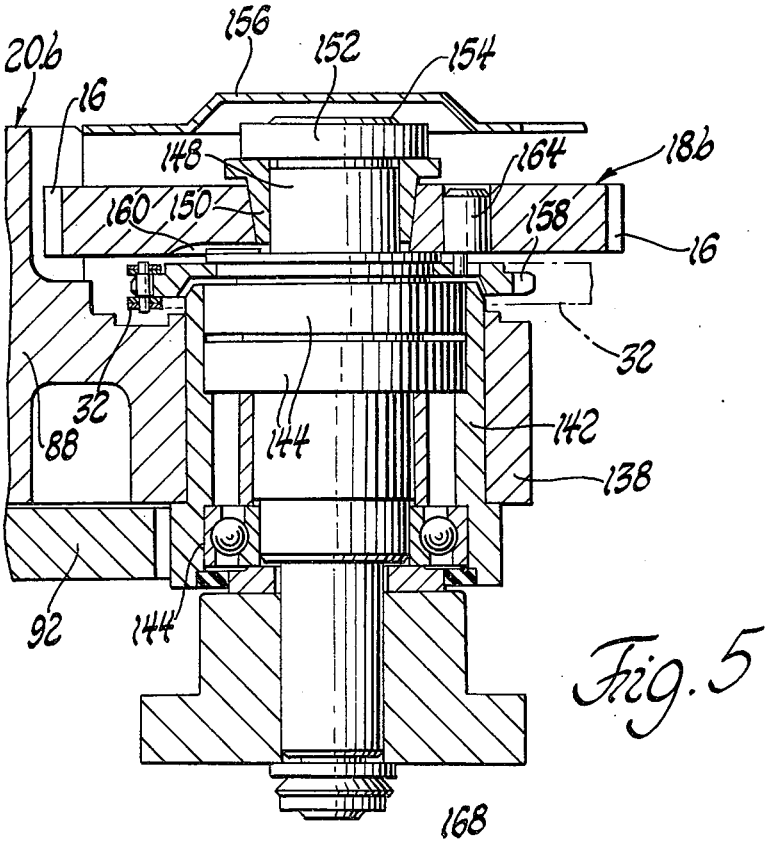
Figure 6:
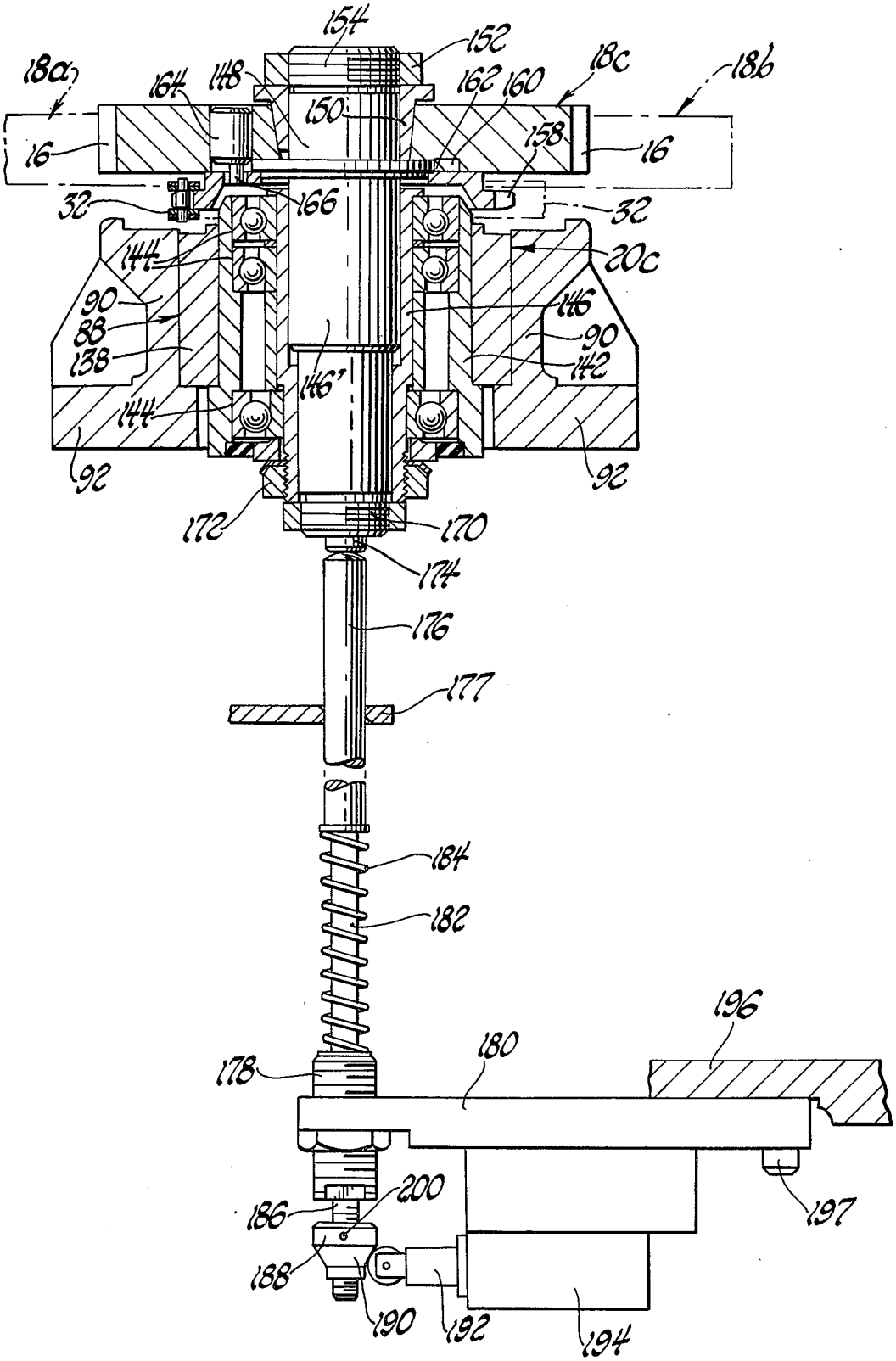

As seen in FIGS. 4, 5, and 6, each cylinder housing 88 includes an annular tool mounting portion 138 receiving an annular antifriction bearing mount 142 press fitted into position. Three antifriction ball bearings 144 are mounted within each bearing mount 142 and support associated tool shafts 146. The tool shafts 146 shown in FIGS. 4 and 5 associated with the cylinder housings of hydraulic cylinders **20*a* and 20*b* are solid and each includes an outer shaft end 148 that is rotatably fixed to the associated rotary tool 18*a* or 18*b* so as to support the tool. Splined collars 150 received over the shaft ends 148 are received within suitable splined openings at the center of the tools so as to rotatably fix the tools on the shafts. The collars 150 are held in place by securement nuts 152 threaded onto the extreme end portions 154 of shaft ends 148. Detachable shields 156 cover the ends of the tool supporting shafts 146. Chain sprockets 158 are rotatably fixed to the associated tools by slots 160 in the tools that receive keys 162 on the sprockets as well as by pins 164 press fitted into the tools and having reduced diameter portions 166 received within suitable openings in the sprockets. A gear or sprocket 168, FIG. 5, on the tool shaft 146 associated with the hydraulic cylinder 20*b* is power driven so that tool 18*b* is power driven. The manner in which tool 18*b*** drives the other tools is described later.

With reference to FIG. 6, the tool shaft 146 associated with the hydraulic cylinder **20*c* has a sleeve-like construction that slidably receives another shaft 146'. The associated rotary tool 18*c* is mounted on shaft 146' in the same manner and with the same components utilized to mount the other tools on their associated shafts and, consequently, like reference numerals are used to indicate the components. However, it is noted that the tool 18*c* is axially offset forward from the other tools 18*a* and 18*b* so as to initially mesh with the gear being processed as the gear is moved rearwardly by the workpiece carriage in the manner previously described. As this initial engagement occurs, the gear 12 will either be meshed or will not be meshed with the tool 18*c*. If it is meshed, the carriage movement continues so as to complete the meshing of the gear with the other tools 18*a* and 18*b*. If it is not meshed, axial engagement of the tool and gear teeth cause the tool shaft 146' to slide rearwardly with respect to the sleeve-like tool shaft 146, or downwardly as shown in FIG. 6. The axial end of shaft 146' opposite tool 18*c* includes a threaded portion 170 receiving a nut 172 which limits the axial movement of the shaft in a forward direction, or upward as shown in FIG. 6, by engaging the axial rear end of sleeve-like shaft 146. A projection 174 adjacent the threaded shaft portion 170 is engaged by a rod 176 that is slidably supported by a suitable plate 177 and a coupling 178 threaded into a support plate 180. Between plate 177 and the coupling 178, rod 176 includes a reduced diameter portion 182 encircled by a helical spring 184. One end of spring 184 is seated against the larger diameter of rod 176 and the other end is seated against the coupling 178 so as to bias the rod, and hence the shaft 146', to its forwardly projected position shown. When nonmeshing of the tool 18c occurs upon initial engagement with the gear 12 being processed, the spring 184 yields to permit axial rearward movement of the tool 18c. A threaded end portion 186 of rod 176 extends through the coupling 178 and carries a control member 188 that includes a control surface 90 for actuating a switch arm 192 of a limit switch 194. Limit switch 194 is mounted on the plate 180 that carries the coupling 178 and this plate is mounted on a portion 196 of the machine housing by bolts 197, only one shown. The limit switch 194 is coupled to the drive mechanism of the machine to terminate the rotation of the tools when the tool 18c is moved axially to indicate an unmeshed condition thereof with the gear workpiece being processed. A set screw 200 permits the control member 188 to be positioned at various locations along a length of rod end 186 so as to control the amount of axial tool movement required to actuate the limit switch 194**.

Figure 10:
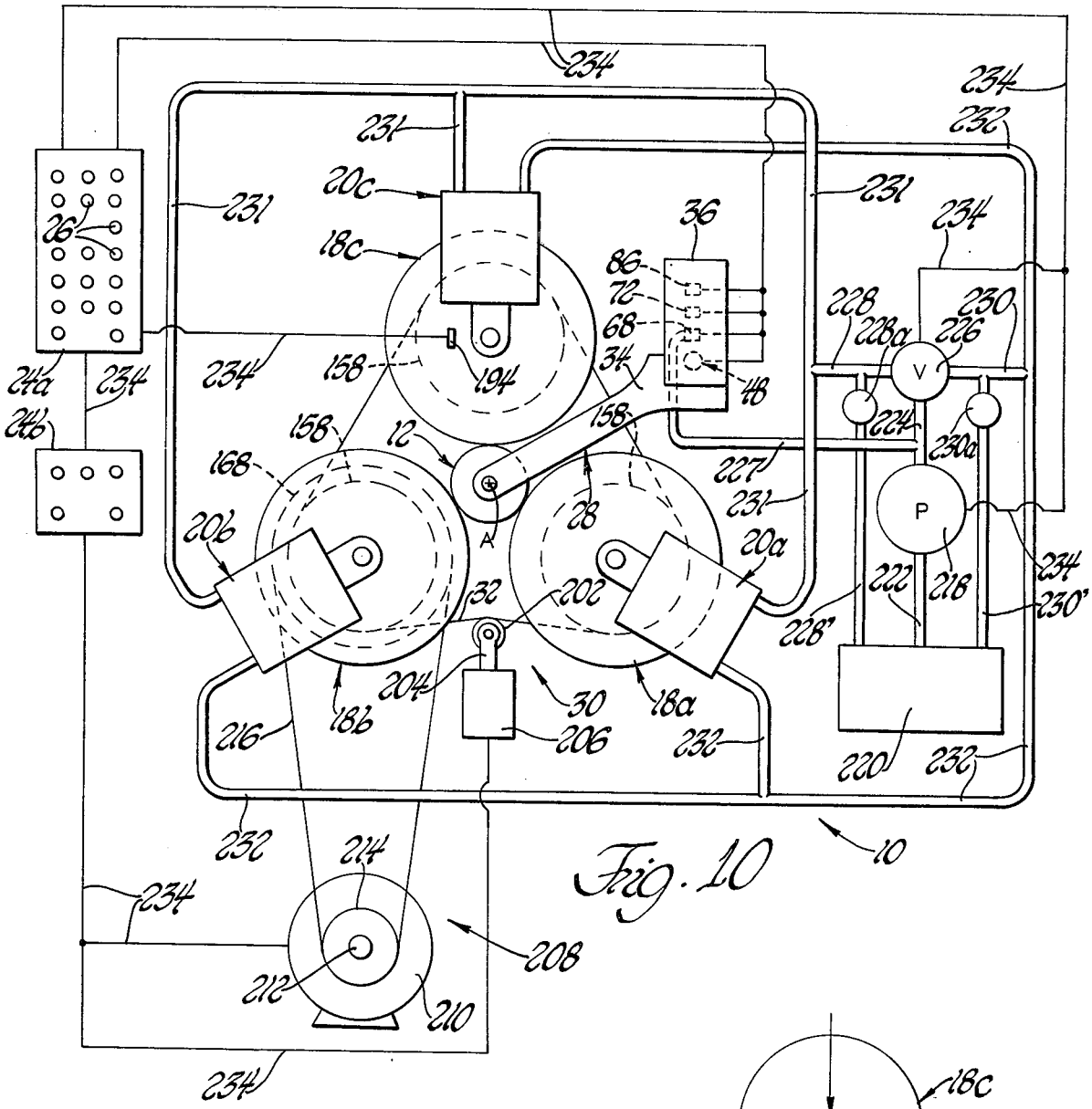
FIG. 10 is a schematic view illustrating the machine embodying apparatus of this invention.

With reference to FIGS. 1 and 10, the synchronizer 30 of the machine 10 includes an idler sprocket 202 meshed with the chain 32 that is trained over the chain sprockets 158 fixed to the shafts that carry the rotary tools 18a, *18b*, and 18c. A support member 204 that rotatably supports the idler sprocket 202 is moved vertically by a suitable actuator 206 mounted on the housing 22 of the machine via vertically adjustable bolt and slot connections 205, FIG. 1. Prior to meshing of the gear 12 with the tools 18a, 18b and 18c, the actuator 206, which may be embodied as a hydraulic cylinder or the like, moves the idler sprocket 202 upwardly to tension the chain 32. The chain then synchronizes the rotation of each of the tools with each other tool so as to cause the teeth of the tools to be in proper alignment for meshing with the gear 12 as it is moved into position by the movable carriage of the carrier 28. Subsequent to the meshing of the gear 12 with the tools, the meshing relationship of the gear and tool teeth provides the synchronization of the tools with each other and the actuator 206 then lowers the chain sprocket 202 so as to relieve the chain 32 from the tension.

As seen in the schematic view of FIG. 10, an electric motor drive mechanism 208 of the machine includes an electric motor 210 whose output shaft 212 carries a chain sprocket 214 that drives a chain 216 trained over the chain sprocket 168, FIG. 5, which drives the tool 18b. Of course, a suitable gear drive train could also be utilized instead of chain 216. Also, a hydraulic pump 218 of the machine receives hydraulic fluid from a reservoir 220 through a conduit 222 and feeds this fluid through an output conduit 224 to a valve 226 as well as to a conduit 227 that feeds the valve 68 which controls fluid flow to the hydraulic cylinder 48 previously described. Valve 226 is selectively and alternately actuatable to feed the hydraulic fluid to either a conduit 228 or a conduit 230. The conduit 228 feeds the hydraulic fluid from a common location through conduits 231 to the passages 126, FIG. 4, of the hydraulic cylinders 20a, 20b, and 20c so as to extend the cylinders and move the tools 18a, 18b and 18c radially inward with respect to the central gear axis A. Conduit 230, on the other hand, feeds the hydraulic fluid from a common point to conduits 232 that feed the hydraulic fluid to the passages 130, FIG. 4, of the cylinders which cause retraction of the cylinders and consequent outward radial movement of the associated tools 18a, 18b and 18c away from axis A. Also, conduits 228 and 230 respectively feed conduits 228' and 230' that include respective bleeder valves 228a and 230a for permitting a small flow of fluid into the reservoir 220. Control wire bundles 234 couple the control panels portions 24a and 24b with the electrically operated controls of the machine 10 and with suitable electrical controls for actuating the flow of hydraulic fluid to the hydraulic components of the machine.

Operation of machine 10 will now be described with reference to the schematic view of FIG. 10. As previously mentioned, an unshown conveyor moves the gears 12 to be processed across the front of the machine and the movable carriage 34 of the carrier 28 is then in its forward position to receive a gear and move it rearwardly toward the three tools 18a, 18b, and 18c. As the gear 12 is being moved rearwardly toward the tools but prior to its meshing with the tool teeth, the chain 32 of synchronizer 30 will be tensioned to synchronize the tool rotation in the manner previously described and the hydraulic pump 218 will then be feeding pressurized hydraulic fluid through the valve 226 to the conduit 230 that feeds conduits 232 to maintain the hydraulic cylinders 20a, 20b, and 20c in their retracted condition. The extent of this retraction does not have to be particularly great, 60/1000ths of an inch will suffice, in order to give sufficient clearance for the gear 12 to readily move into meshing relationship with the tools in the manner previously described. Subsequent to the movement of the gear into meshing relationship with the tools, the valve 226 is actuated to switch the flow of pressurized hydraulic fluid from conduit 230 to conduit 228 so as to supply pressurized fluid to the conduits 231 so as to move cylinders 20a, 20b, and 20c to their extended condition. Each cylinder is extended to apply pressure between the meshed surfaces of its associated tool and the gear. The meshing of the power driven tool 18b through the gear 12 synchronizes the rotation of the other tools 18a and 18c with it. At this time, the idler sprocket 202 will be lowered so as to relieve the synchronizer chain 232 from tension and the chain then plays no part in the operation of the machine.

With continuing reference to FIG. 10, the drive mechanism 208 accelerates the rate of rotation as the pressure is applied between the rotary tools 18a, 18b and 18c and the gear 12 and continues this accelerated rate of rotation in one direction and then in the other to complete the processing of the gear 12. After the gear has been processed, the valve 226 is actuated to switch the hydraulic fluid flow back to conduit 230 so as to cause retraction of the cylinders 20a, 20b and 20c such that the movable carriage of the carrier 28 may then move the processed part forwardly out of meshing relationship with the rotary tools.

Figure 7:
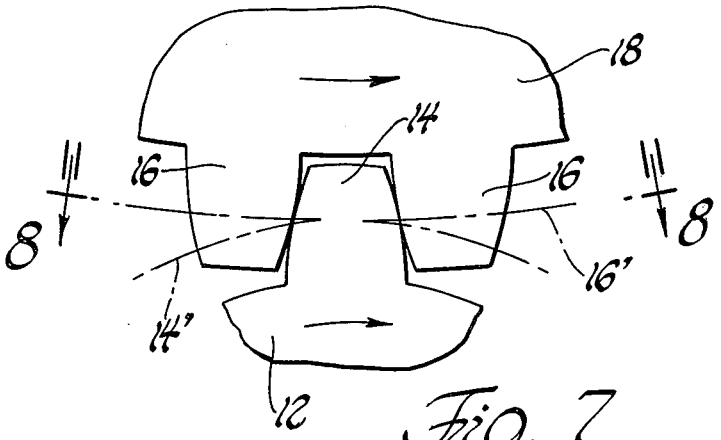
FIG. 7 is a partial view showing the intermeshed relationship between tool teeth and a gear tooth of a gear that is being processed by the machine.

With reference to FIG. 7, the gear teeth 14 of gear 12 slide in meshing relationship with the teeth 16 of the associated tool 18 except when the interengaged tooth surfaces are located along the respective tooth pitch lines 14' and 16'. At this aligned relationship for an instantaneous moment, the involute configuration of the tooth surfaces do not require any sliding movement between the teeth. If a defect in the form of a "high spot" on one of the tooth surfaces is encountered, the associated hydraulic cylinder 20a, 20b or 20c permits outward radial movement of the associated tool independently of each other tool to accommodate for this defect.

The manner in which each cylinder 20*a*, 20*b*, and 20*c* permits outward movement of its associated tool independently of each other cylinder and tool can best be understood by reference to FIG. 4. Chamber 128 of the cylinder bore will then be receiving the hydraulic fluid to extend the cylinder and apply pressure between its associated tool and the gear. However, piston 104 is slightly undersized and lacks any seals such that a predetermined amount of leakage flow from chamber 128 to annular chamber 132 takes place. When a "high spot" gear surface defect is engaged by the tool carried by the cylinder, the outward force on the tool urges the cylinder toward its retracted condition. Such retraction is then allowed by an increase in the rate of leakage flow past the piston for the instant that the tool is engaged with the surface defect. After the tool disengages the defect, the leakage flow decreases to its predetermined rate as the cylinder moves back toward its extended condition to move the tool inwardly. The outward tool movement allowed by the cylinder retraction of each cylinder independently of each other cylinder permits the gear 12 to rotate with its central axis A constantly fixed at a given location. It has been found that this causes good surface characteristics on the gears being processed with a greatly reduced rejection rate relative to prior art machines of this type.

Figure 11:
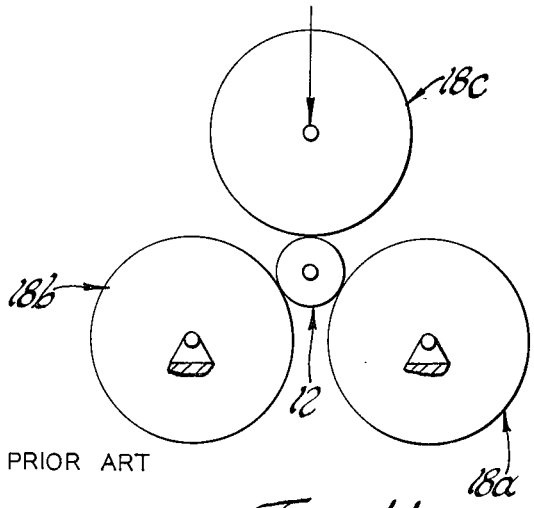
PRIOR ART Fig. 11
FIG. 11 is a schematic view illustrating prior art machines of the type to which this invention relates.

As seen in FIG. 11, prior art machines of the type involved have included two fixed rotary tools 18*a* and 18*b* that rotate about fixed axes and a single rotary tool 18*c* that is movable to accommodate for high spot defects between the interengaged surfaces of the gear 12 and the tools 18*a*, 18*b*, and 18*c*. For example, if there is a high spot between gear 12 and tool 18*a*, the rotational axis of movement of the gear will move upwardly and at the same time will change the orientation between the intermeshed surfaces of the gear and tools 18*b* and 18*c*. This change in orientation causes a rapid sliding between the gear surfaces and the engaged surfaces of tools 18*b* and 18*c*. Likewise, a high spot between gear 18*b* and the gear 12 causes the axis of gear rotation to move upwardly and concomittantly change the orientation between intermeshed surfaces of the gear and tools 18*a* and 18*c* with a consequent rapid sliding between their meshed surfaces.

With reference to FIG. 10, the bleeder valves 228*a* and 230*a* are utilized to permit the fluid leakage flow of the cylinders 20*a*, 20*b*, and 20*c* to be returned to the reservoir 220. These valves permit only a small amount of fluid flow therethrough so as not to affect the ability of the pump 218 to supply sufficient pressurized fluid for the cylinders to apply the required pressure between the tools and the gear. When the valve 226 directs the fluid from pump 218 to conduits 228 and 231 so as to extend the cylinders and apply pressure between the tools and the gears, the leakage flow through the cylinders passes through conduits 232 and 230 to bleeder valve 230*a* and through the conduit 230' to the reservoir 220. Likewise, when the valve 226 directs the pumped fluid to conduits 230 and 232 so as to retract the cylinders, the leakage flow through the cylinders passes through conduits 231 and 228 to bleeder valve 228*a* and through conduit 228' back to reservoir 220.

Also, while it is preferable to use an undersized piston without seals as shown in FIG. 4 to achieve the leakage flow, it would also be possible to provide a small hole through the cylinder piston 104. This hole would interconnect cylinder bore chambers 128 and 132 to permit the leakage flow between the chambers even if the piston were sealed as it slides relative to the cylinder bore.

Figure 8:
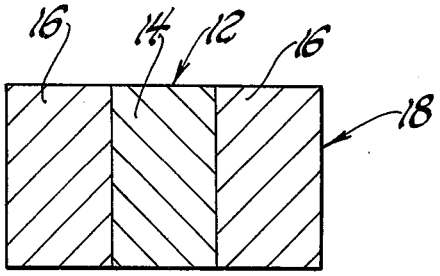
FIG. 8 is a sectional view of the gear and tool teeth taken approximately along the pitch diameter 8—8 of the tool teeth shown in FIG. 7.
Figure 9A:
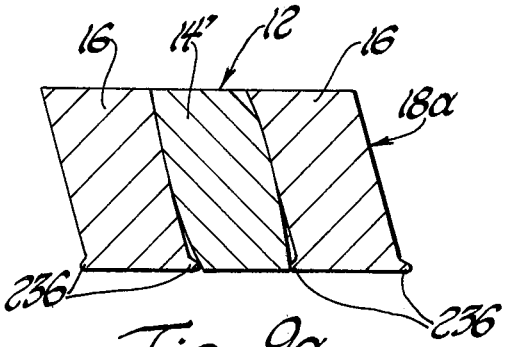
FIGS. 9*a*, 9*b*, and 9*c* are views similar to FIG. 8 of different tooth forms utilized with three rotary tools of the machine to remove surface defects from different axial surface portions of the gear tooth.
Figure 9B:
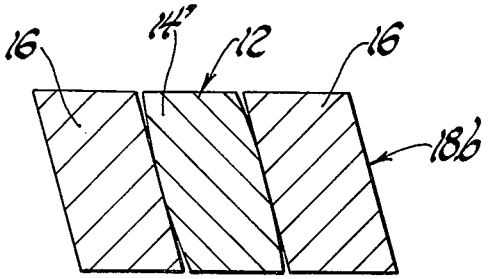
Figure 9C:
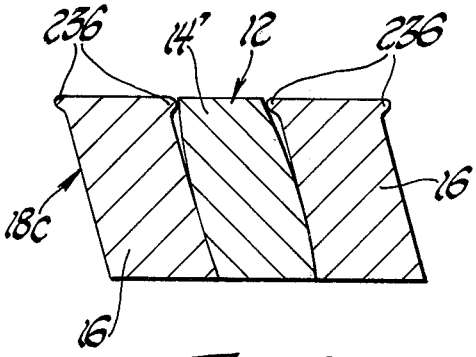

When the machine 10 is utilized to remove surface defects from a gear whose teeth are parallel to the central axis of the gear, such as the tooth 14 of the gear shown in FIG. 8, each of the tool teeth 16 engages the complete axial length of the gear tooth at their intermeshed surfaces. In such cases, each of the rotary tools 18*a*, 18*b*, and 18*c* will have a tooth form identical to the others. However, certain gear teeth, such as the tooth 14' shown in FIGS. 9*a*, 9*b*, and 9*c*, are skewed in the axial direction and have surfaces that are curved between the opposite axial ends of the gear. If this is the case, the tooth forms of each tool 18*a*, 18*b*, and 18*c* will vary so that each engages a different axial surface portion of the gear tooth. Thus the teeth 16 of the tool 18*a* will remove surface defects from the axial upper portion of the tooth 14' while the tooth 16 of tool 18*b* will remove defects from the axial central portion and the teeth 16 of the tool 18*c* will remove defects from the axial lower portion of the gear tooth. Clearances are thus present between the tooth surface portions at different locations. The teeth 16 of tools 18*a* and 18*c* include projections 236 that prevent an axial unbalanced condition of the gear loading from occurring due to the pressure applied at one axial side of the gear. It should be noted that the clearances shown in FIGS. 9*a*, 9*b*, and 9*c* are greatly exaggerated for purposes of illustrating the tooth configuration involved and that these clearances are normally on the order of 1/1000th of an inch or less.

While a preferred embodiment of the apparatus and the method for removing defects from a workpiece has herein been described in detail, those skilled in the art will recognize various alternative designs, embodiments and methods for practicing the present invention as defined by the following claims.

What is claimed is:

1. Apparatus for removing surface defects from a formed workpiece having a rotary axis about which the workpiece is designed to rotate, said apparatus comprising: at least two rotary tools rotatably mounted in spaced relationship to each other so as to receive the workpiece therebetween; at lease one of said rotary tools being power driven; pressure applying means for independently biasing each tool radially in an inward direction with respect to the rotary axis of the workpiece and for independently permitting each tool to move outwardly in a radial direction with respect to he rotary axis of the workpiece, rotation of said power driven tool causing rotation of the workpiece while said pressure applying means engages the tools with the workpiece to remove surface defects therefrom, and the pressure applying means permitting each tool to move outwardly independently of each other tool upon engaging a defect of the workpiece while the workpiece continues rotating with the rotary axis thereof at a fixed location; said pressure applying means including a plurality of cylinders having pistons therein which allow leakage flow between the opposite sides thereof within their associated cylinders, each cylinder and piston being respectively associated with one tool; and fluid pump means for biasing the pistons within the cylinders while leakage flow takes place at an increased rate to permit outward tool movement upon engagement with a defect on the workpiece.

2. Apparatus for removing surface defects from a toothed workpiece having a rotary axis about which the workpiece is designed to rotate, said apparatus comprising: a plurality of rotary tools rotatably mounted in spaced relationship to each other so as to receive the workpiece therebetween and having teeth for meshing with the teeth of the workpiece; one of said rotary tools being power driven; and pressure applying means for independently biasing each tool radially in an inward direction with respect to the rotary axis of the workpiece and for independently permitting each tool to move outwardly in a radial direction with respect to the rotary axis of the workpiece, rotation of said power driven tool causing rotation of the workpiece while said pressure applying means engages and meshes the tools with the workpiece to remove surface defects therefrom, the pressure applying means permitting each tool to independently move outwardly upon engaging a surface defect of the workpiece while the workpiece continues rotating with the rotary axis thereof at a fixed location, the pressure applying means including an extendable and retractable cylinder associated with each tool to provide the biasing thereof, each cylinder including a bore and an undersized piston received within the bore thereof, and conduit means for continuously feeding pressurized fluid to the cylinder bore to bias the cylinder to an extended condition while permitting leakage fluid flow between the opposite sides of the associated piston at a predetermined rate, and engagement of each tool with a defect on the workpiece causing outward tool movement which is permitted by an increase in the rate of leakage fluid flow above the predetermined rate.

3. Apparatus as claimed in claim 2 wherein the conduit means connects each cylinder bore to a first common point on one side of the pistons thereof and also feeds the leakage fluid to a second common point, and pump means for selectively and alternately supplying pressurized fluid to one of the common points, pressurized fluid supplied to the first common point biasing the tools into engagement with the workpiece, and pressurized fluid supplied to the second common point positioning the tools outwardly to permit axial movement of the workpiece along the rotary axis thereof so as to allow removal of a processed workpiece and mounting of a workpiece to be processed.

4. Apparatus as claimed in claim 2 wherein there are three toothed tools biased by three associated cylinders.

5. Apparatus as claimed in claim 4 wherein the three cylinders associated with the tools are oriented to bias the tools along radii of the workpiece axis which are spaced circumferentially with 120° angles therebetween.

6. Apparatus as claimed in claim 5 which includes synchronizing means that connects the power driven tool to the other two tools for synchronized rotation therewith prior to meshing of the tools with a workpiece.

7. Apparatus as claimed in claim 6 wherein the synchronizing means includes sprockets on the tools and a chain trained over the sprockets.

8. Apparatus as claimed in claim 7 and also including an idler sprocket for tensioning the chain prior to meshing of the workpiece with the tools and for loosening the chain to allow the workpiece to synchronize the tools upon meshing therewith.

9. Apparatus as claimed in claim 6 and also including carrier means for positioning the workpiece between the tools.

10. Apparatus as claimed in claim 9 wherein the carrier means includes a movable carriage for carrying the workpiece between the tools, and one of the tools being positioned to mesh with the workpiece prior to the other tools upon being carried by the carriage between the tools.

11. Apparatus as claimed in claim 10 and also including control means for moving the carriage at different rates, the carriage being moved at a fast rate prior to meshing of the workpiece with the tools and at a slow rate during the meshing of the workpiece with the tools.

12. Apparatus as claimed in claim 11 wherein the control means includes a hydraulic control circuit having a control valve actuated by the carriage movement to control the rate of carriage movement.

13. Apparatus as claimed in claim 10 and also including positioning means for axially biasing the one rotary tool which meshes with the workpiece prior to the other tools.

14. Apparatus as claimed in claim 13 wherein the positioning means includes a deactuator for terminating rotation of the tools upon axial movement of the one tool against the bias of the positioning means.

15. Apparatus as claimed in claim 2 and also including power means for rotating said power driven tool in one direction and then in the other direction to remove surface defects from opposite circumferential sides of the workpiece teeth.

16. Apparatus as claimed in claim 2 wherein each tool has a tooth form identical to the tooth form of the other tools.

17. Apparatus as claimed in claim 2 wherein each tool has a tooth form different than the tooth form of the other tools so as to mesh with and remove surface defects from a certain portion of the workpiece teeth.

18. Appatus for removing surface defects from a toothed gear having a rotary axis about which the gear is designed to rotate, said apparatus comprising: three rotary tools having teeth for meshing with the teeth of the gear; one of said tool being power driven; three hydraulic cylinders respectively supporting the tools for rotation in spaced relationship with respect to each other so as to receive the gear therebetween in a meshing relationship; and each cylinder including a bore and an undersized piston received within the bore thereof such that piston movement extends and retracts the cylinders to move the tools toward and away from each other, the cylinders being oriented and spaced with respect to each other such that the tools are moved toward and away from a common junction at which the rotary axis of the gear is located while meshing with the tools, the cylinders being extended upon being continuously supplied with a hydraulic fluid within the bores thereof on one side of the associated pistons so as to apply pressure between the tool teeth and the gear teeth as the fluid leaks past the pistons between the opposite sides thereof within the associated cylinder at a predetermined rate, each cylinder permitting its associated tool to move outwardly independently of the other tool in a radial direction with respect to the rotary gear axis upon engagement with a surface defect of the gear teeth during rotation of the gear by the power driven tool, and the fluid leakage past each piston being at an increased rate to permit the outward movement of the associated tool while the gear continues rotating with its rotary axis at a fixed location.

19. Apparatus for removing surface defects from a toothed gear having a rotary axis about which the gear is designed to rotate, said apparatus comprising: three rotary tools for meshing with the teeth of the gear; three hydraulic cylinders respectively supporting the tools for rotation in spaced relationship with respect to each other so as to receive the gear therebetween in a meshing relationship; each cylinder including a bore and an undersized piston received within the bore thereof such that relative movement of the piston within the bore extends and retracts the cylinder to move the tools toward and away from each other; the cylinders being oriented and spaced with respect to each other such that the tools are moved toward and away from a common junction at which the rotary axis of the gear is located while meshing with the tools; the movement of the tools being along gear axis radii that are spaced from each other at angles of 120°; pump means for continuously supplying hydraulic fluid to the cylinder bores to extend the cylinders and apply pressure between the tool teeth and the gear teeth as the fluid leaks past the pistons between the opposite sides thereof within the associated cylinders at a predetermined rate; each cylinder permitting its associated tool to move outwardly independently of the other tools upon engagement with a surface defect of the gear teeth during rotation of the tools in a meshing relationship with the gear and the fluid leakage past each piston being at an increased rate above the predetermined leakage rate to permit the outward movement of its associated tool; a carrier including a movable carriage for moving the gear between the tools in meshing relationship therewith; and power means for rotating the tools first in one direction and then in the other direction while meshed with the gear such that pressure applied between the gear and tool teeth removes surface defects from the gear teeth while outward tool movement permitted by the cylinders maintains the rotating gear with its rotary axis at a fixed location.

20. A method for removing surface defects from a formed workpiece, the method comprising: positioning the workpiece between at least two rotary tools in engagement therewith; rotating the tools and the workpiece engaged therewith; and applying pressure between each tool and the workpiece independently of each other tool by cylinders having fluid biased pistons received therein which permit leakage fluid flow between the opposite sides thereof within the cylinders so that each tool can independently move outwardly upon engaging a surface defect of the workpiece as the rate of leakage flow is thereby increased in a manner that permits the workpiece to continue rotating with its rotary axis at a fixed location.

21. A method for removing surface defects from teeth of a gear, the method comprising: positioning the gear between three rotary tools having teeth that mesh with the gear teeth; the tools and the gear meshed therewith; and applying pressure between each tool and the gear independently of the other tools by cylinders having fluid biased undersized pistons received therein which permit leakage fluid flow between the opposite sides thereof within the cylinders so that each tool can move outwardly indepedently of the other tools upon engaging a surface defect of the gear as the rate of leakage flow is thereby increased in a manner that permits the workpiece to continue rotating with its rotary axis at a fixed location.

* * * * *